United States Patent [19]

Kindaichi

[11] Patent Number: 5,052,354

[45] Date of Patent: Oct. 1, 1991

[54] HORIZONTALLY-OPPOSED MULTIPLE-CYLINDER ENGINE WITH A GAS BAFFLE

[75] Inventor: Masahito Kindaichi, Tokyo, Japan

[73] Assignee: Fuji Jukogyo Kabushiki Kaisha, Tokyo, ; JPX

[21] Appl. No.: 599,366

[22] Filed: Oct. 18, 1990

[30] Foreign Application Priority Data

Oct. 25, 1989 [JP] Japan ..... 1-279110

[51] Int. Cl.[5] ..... F02B 75/00

[52] U.S. Cl. ..... 123/196 CP; 123/56 AA

[58] Field of Search ..... 123/56 AA, 56 AC, 56 BA, 123/56 BC, 196 CP, 196 AB, 196 R, 317, 318; 184/6.5

[56] References Cited

U.S. PATENT DOCUMENTS 1,094,431 4/1914 Frederickson ..... 123/196 CP
2,506,250 5/1950 Taub ..... 123/56 AA
2,969,781 1/1961 Kolbe ..... 123/56 AA
4,708,107 11/1987 Stinebaugh ..... 123/56 AA

*Primary Examiner*—Andrew M. Dolinar
*Assistant Examiner*—M. Macy
*Attorney, Agent, or Firm*—Beveridge, DeGrandi & Weilacher

[57] ABSTRACT

A horizontally-opposed multiple-cylinder engine provided with a cylinder block having two banks respectively including cylinders in which pistons are moved to bottom dead centers in order. A gas baffle is disposed between the lower portion of a crank chamber defined between the two banks in the cylinder block and lubrication oil in an oil pan disposed below the crank chamber. The gas baffle is made of steel plate by drawing treatment and is provided with an opening formed at an end portion thereof opposed to one cylinder which operates to force gas in the crank chamber to an upper space thereof.

4 Claims, 4 Drawing Sheets

HORIZONTALLY-OPPOSED MULTIPLE-CYLINDER ENGINE WITH A GAS BAFFLE

BACKGROUND OF THE INVENTION

The present invention relates to a horizontally opposed multiple cylinder engine and, more particularly, to a gas baffle provided for the horizontally-opposed multiple-cylinder engine for improving flow of gas generated in a crank chamber during an engine operation.

It is generally known to be better to utilize the horizontally-opposed multiple-cylinder engine, in which mutually opposing pistons assembled in the corresponding cylinders are symmetrically operated, to carry out so-called boxer-type operation, in consideration of engine balance during the engine operation.

In multiple cylinder engines in which boxer-type piston operation is carried out, when the mutually opposed pistons are moved from top dead centers to bottom dead centers, gas remaining in a space between opposed pistons in the crank chamber of the engine is compressed and blasted towards a low gas pressure area in the crank chamber.

This gas blasting pressure is low during low engine speed operation or steady engine speed operation. In such operation, the gas blasting pressure hardly affects an oil surface of lubrication oil stored in an oil pan. However, during high engine speed operation, the lubrication oil may be forced upwardly and rearwardly in the engine by the gas blasting pressure. This causes to rise the oil level of the lubrication oil stored in the rear portion of the oil pan and, to increase the lubrication oil temperature, the raised portion of the lubrication oil is splashed by crank weights and the temperature of the lubrication oil is raised. Moreover, the oil may be agitated so that air bubbles may be formed in the lubrication oil which is then sucked into a strainer, resulting in the lowering of the lubrication oil pressure or the degradation of the engine performance.

In order to obviate these defects or problems, the prior art provides a technique disclosed, for example, in the Japanese Utility Model Laid-open Publication No. 63-102916, in which a baffle plate is interposed between lubrication oil stored in the oil pan and the crank chamber to shut out the gas blasting pressure by the baffle plate. However, in this prior art, when the downstream side of the crank chamber is entirely shut off by the baffle plate, a gas pressure in the crank chamber increases. Particularly, during high engine speed operation, the gas pressure cannot escape and, hence, a so-called pumping loss is caused, resulting in degradation of the engine output performance.

As a countermeasure to this defect, it is considered to locate the baffle plate to shut out only a part of the gas blasted towards the lubrication oil surface. However, in this case, the gas blasting pressure is partially increased and smooth gas flow is not expected. Accordingly, in this countermeasure, such problems as described above will also not be completely solved.

SUMMARY OF THE INVENTION

An object of the present invention is to substantially eliminate defects and drawbacks encountered in the prior art described above and to provide a horizontally-opposed multiple-cylinder engine provided with an improved gas baffle capable of preventing the generation of pumping loss even during high engine speed operation and significantly reducing the waving of a lubrication oil stored in an oil pan, thus effectively avoiding output loss of the engine, lowering of oil pressure and a rise in the temperature of the lubrication oil.

This and other objects can be achieved according to the present invention by providing a horizontally-opposed multiple-cylinder engine provided with a cylinder block having two opposed banks respectively including cylinders in which pistons move to bottom dead centers comprising a crank chamber defined between the two banks in the cylinder block and provided with an upper space, an oil pan disposed below the crank chamber wherein a lubrication oil is stored, and a gas baffle disposed between a lower portion of the crank chamber and the lubrication oil stored in the oil pan at a position where a gas flows downwardly from the upper space, the gas baffle being provided an opening formed at an end portion of the gas baffle opposed to one cylinder which operates to force gas in the crank chamber to the upper space therein.

According to the horizontally-opposed multiple cylinder engine provided with an improved gas baffle of the present invention of the character described above, when the bottom dead centers of pistons assembled in the respective cylinders arranged bilaterally alternatingly are moved from one cylinder to another cylinder, gas is forcibly moved from the upper space of the crank chamber towards another cylinder. The gas then flows downwardly in the crank chamber and further flows towards the aforementioned one cylinder while being guided by the gas baffle device arranged between the lower portion of the crank chamber and the lubrication oil stored in the oil pan. The gas is thereafter discharged towards the upper space of the crank chamber due to the gas pressure difference through the opening formed to the end portion of the gas baffle device and opened to the aforementioned one cylinder, thereby establishing effective gas pressure circulation.

A preferred embodiment of the present invention will become understood from the following detailed description referring to the accompanying drawings.

DESCRIPTION OF THE PREFERRED EMBODIMENT

Figure 6:
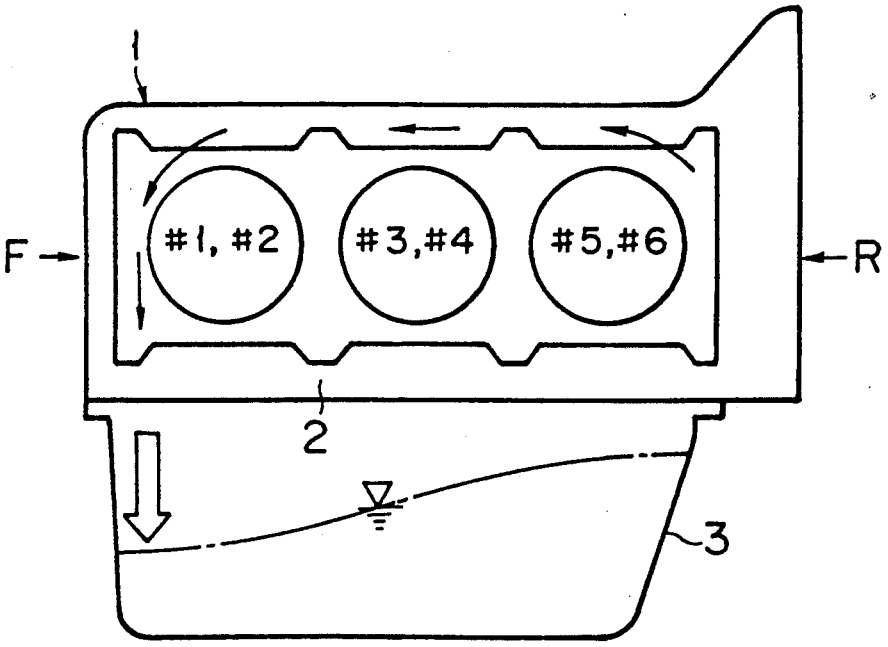
FIG. 6 PRIOR ART
FIG. 6 is a schematic side view of a conventional horizontally-opposed six-cylinder engine.
Figure 5A:
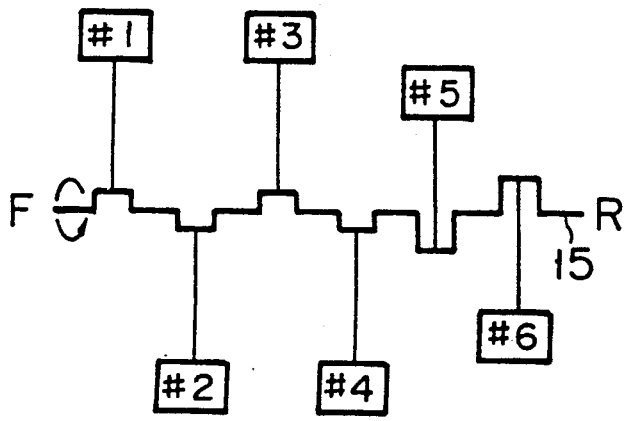
FIGS. 5A to 5C are views representing an engine combustion cycle of a typical six-cylinder engine.
Figure 5B:
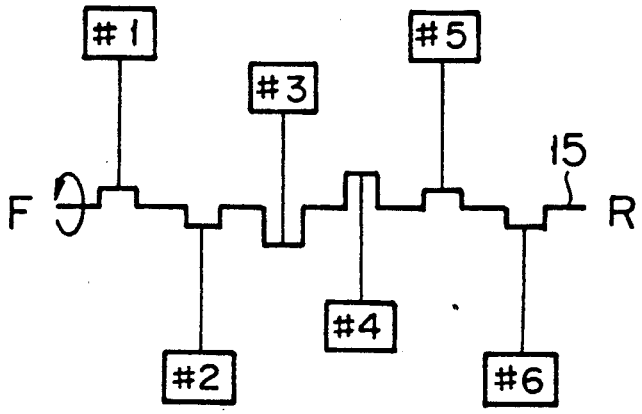

Referring to FIGS. 5 and 6, an engine 1 has a right bank with three cylinders numbered #1, #3, #5 from the front side of the engine 1 and a left bank with three cylinders numbered #2, #4, #6 and provides a firing order of #1-#6-#3-#2-#5-#4.

Figure 5C:
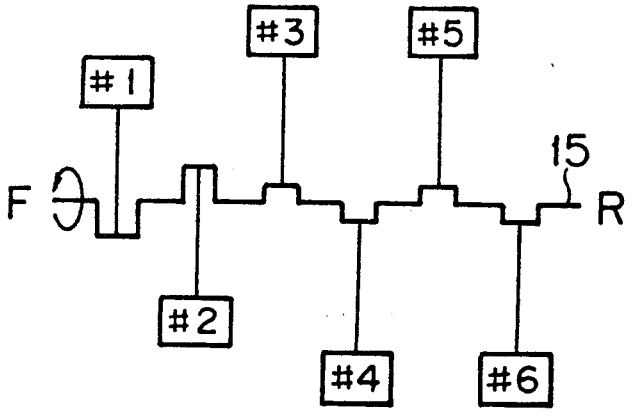

During these ignition operations, (a) when the pistons in the cylinders (#6/#5) are moved from the top dead centers to the bottom dead centers, the gas compressed between these opposed pistons is pushed outward in an upper space of a crank chamber 2 in the engine 1 by the pressure difference (FIG. 5A), (b) then, when the pistons in the cylinders (#4/#3) are moved to the bottom dead centers, the gas pushed into the upper space in the crank chamber 2 is pushed towards the front portion of the engine 1 (FIG. 5B), and (c) in the next step, when the pistons in the cylinders (#2/#1) are moved to the bottom dead centers, the gas moving in the upper space in the crank chamber 2 is blasted towards an oil pan 3 from the front portion of the engine 1 (FIG. 5C).

During these operations of the six cylinder engine, as described hereinbefore, the blasting pressure is low for low engine speed operation or engine steady speed operation. During such operation, the gas blasting pressure hardly affects the oil surface level of lubrication oil stored in the oil pan 3. However, during the engine high speed operation, the lubrication oil may be forced upwardly and rearwardly in the engine 1 by the gas blasting pressure. This results in that the oil level of the lubrication oil stored at the rear portion of the oil pan 3 is raised and, in an adverse case, the raised portion of the lubrication oil is splashed by crank weights for the cylinders #5 and #6, resulting in an increase in the temperature of the lubrication oil. Moreover, the oil surface may be agitated and air bubbles may be formed in the lubrication oil which is sucked into a strainer, resulting in the lowering of the lubrication oil pressure or the degradation of the engine performance.

In order to eliminate these defects, the prior art provides a technique, as described hereinbefore, for locating a baffle plate between lubrication oil stored in the oil pan and the crank chamber, but this technique also involves the problems described before.

The present invention conceived for solving the problems or defects of the prior art described above will be described hereunder with reference to the accompanying drawings, i.e. FIGS. 1 to 4 and, in the illustration, a horizontally-opposed multiple-cylinder engine is designated in its entirety by a reference numeral 11 as a six-cylinder engine.

Figure 4:
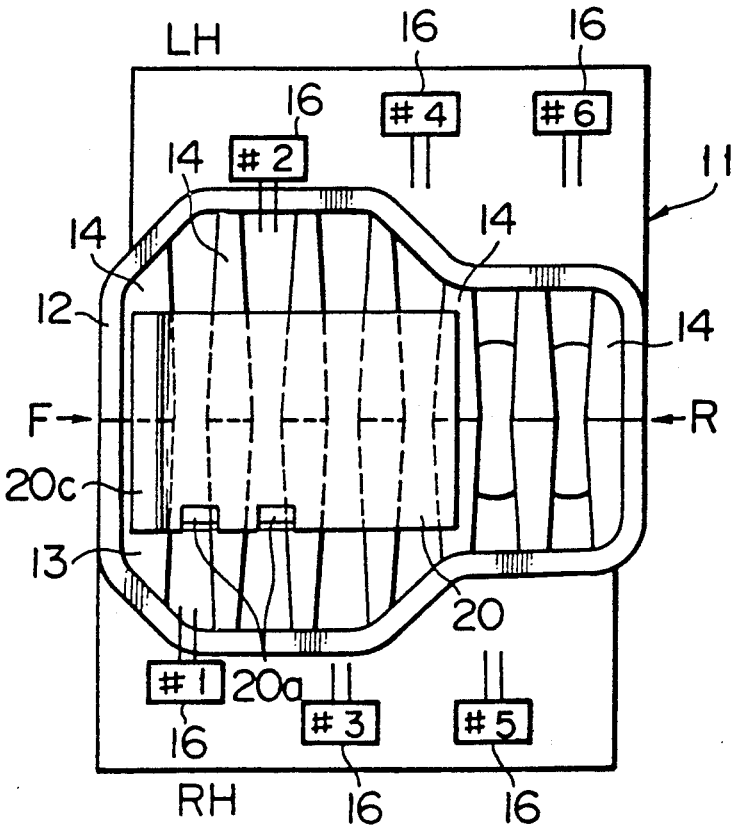
FIG. 4 is a schematic view of the engine from which an oil pan is removed.

The engine 11 is provided with a cylinder block 12 which is divided into two bilateral banks LH and RH with a crank chamber 13 being formed at a central portion between these banks LH and RH (FIG. 4).

In the crank chamber 13, a plurality (seven, in the illustration) of bearing members 14 are incorporated so as to extend from the bilateral two banks of the cylinder block 12. Journal portions formed between crank pins of a crank shaft 15 (FIG. 5) and at both ends of the crank shaft 15 are supported by the bearing members 14 through bearings. To the crank pins are coupled pistons 16 (FIG. 4) which are assembled to be movable in the respective cylinders #1 to #6 disposed alternatingly in the bilaterally arranged banks LH and RH (FIG. 4). An upper space 17 penetrating the upper portions of the bearing members 14 is formed in the upper portion of the crank chamber 13.

The ignitions of the respective cylinders are carried out in the order of #1-#6-#3-#2-#5-#4.

Figure 3:
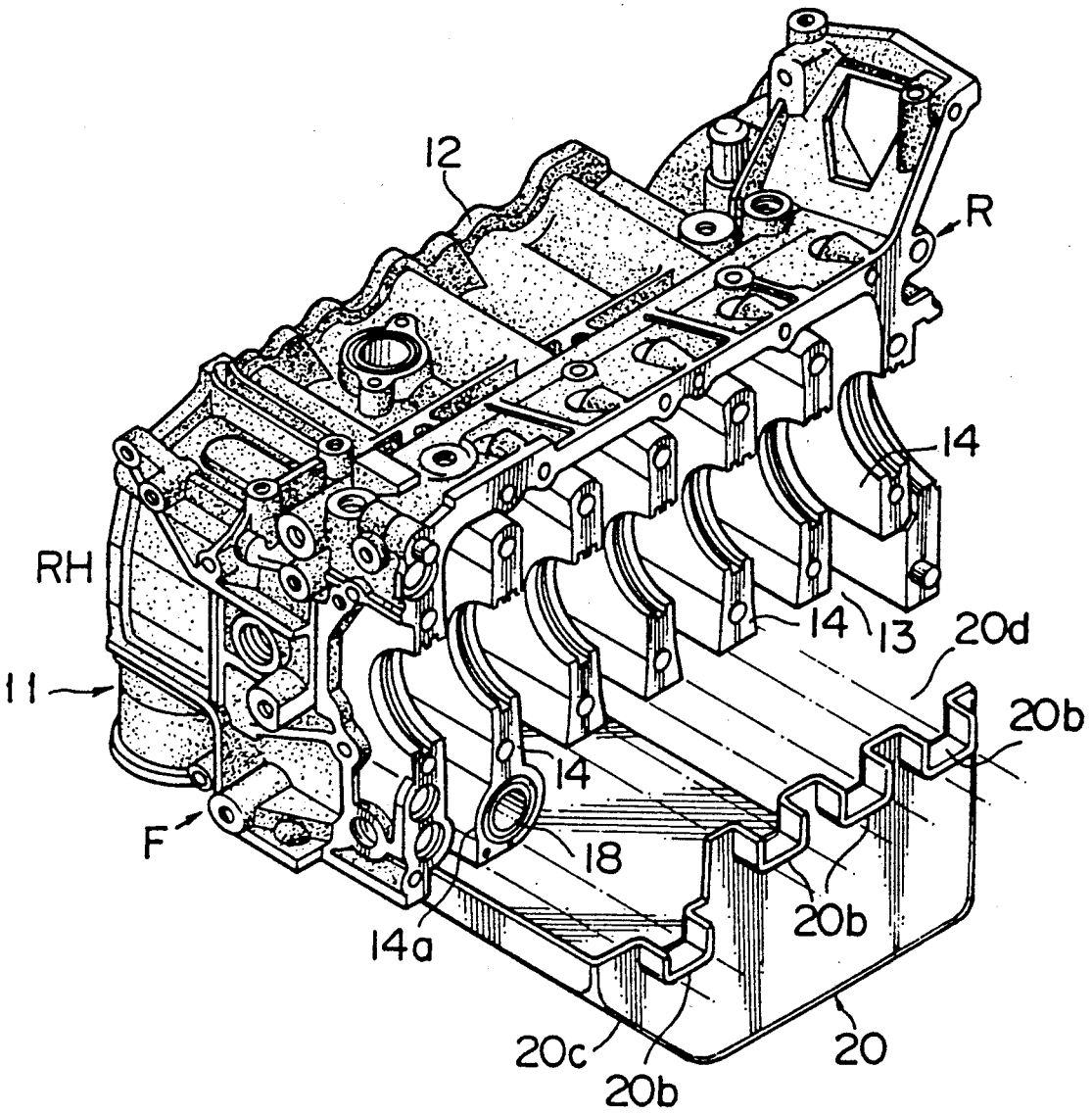
FIG. 3 is a perspective view of a cylinder block provided with a gas baffle of the engine shown in FIG. 1.

A first bearing member 14 assembled between the cylinders #1 and #2 extends slightly downward. A cooling water passage 18, as shown in FIG. 3, communicating with a water jacket, not shown, formed in the banks LH and RH of the cylinder block 12 is bored at an end portion 14*a* of the aforementioned first bearing member 14. Spaces are defined between the respective bearing members 14 and the extended end portion 14*a* of the first bearing member 14 is expanded by the amount corresponding to the width of the cooling water passage 18 formed therein. Accordingly, the spaces between the bearing member 14 to which the cooling water passage 18 is formed and the bearing members adjacent to the first bearing member are made narrow.

Figure 1:
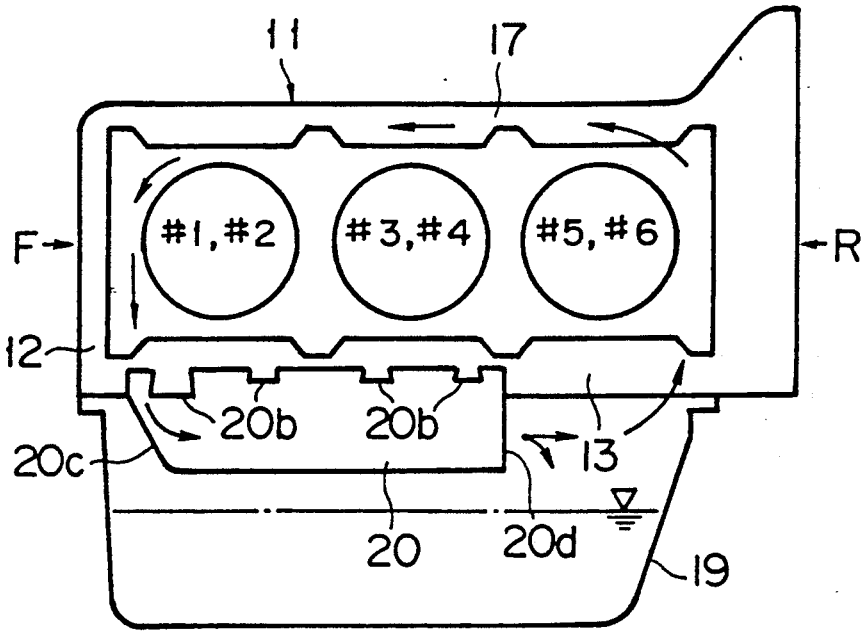
FIG. 1 is a schematic side view of a horizontally-opposed six-cylinder engine according to an embodiment of the present invention.

Referring to FIG. 1, an oil pan 19 is arranged below the crank chamber 13 and a gas baffle 20 formed by effecting a drawing treatment to a steel plate, for example, is interposed between lubrication oil stored in the oil pan 19 and the lower position of the crank chamber 13. The gas baffle 20 is arranged so as to close the lower portion of the crank chamber 13 corresponding to the location of the cylinders #1 to #4 from the front side of the engine 11.

Figure 2:
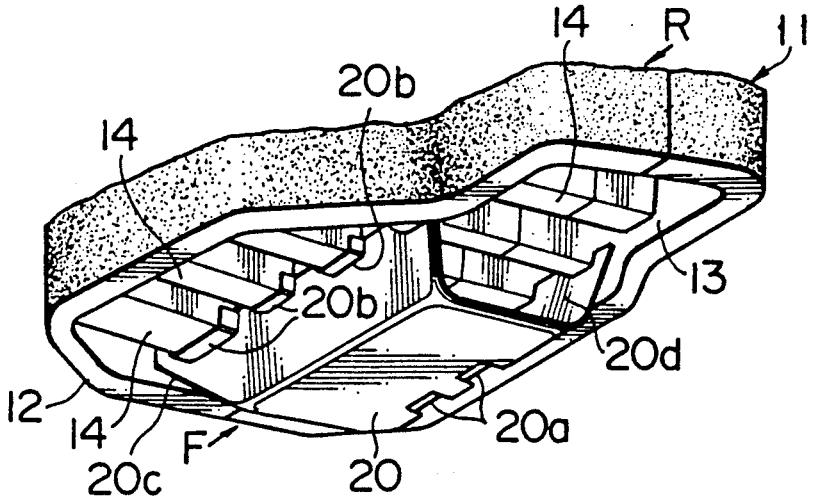
FIG. 2 is a perspective view of a crank chamber of the engine shown in FIG. 1 viewed from a bottom side thereof.

As shown in FIG. 2, the gas baffle 20 is provided with oil return ports 20*a* on one side of the gas baffle 20 and hook portions 20*b* are formed at the upper ends on both sides of the gas baffle 20. The hook portions 20*b* are engaged with the lower ends of the respective bearing members 14 and secured thereto by screws, not shown, for example. The gas baffle 20 is further provided with a guide surface 20*c* formed to the front portion thereof and an opening 20*d* at the rear portion of the gas baffle 20.

The described embodiment operates in the following manner.

When the engine starts the respective cylinders #1 to #6 are ignited in the order of (#1-#6-#3-#2-#5-#4.

Namely, the cylinder #6 and #5 is first ignited and the piston 16 assembled in the cylinder is retracted, i.e. rearwardly moved, to compress the gas in the crank chambers 13. The gas is forcibly moved to the upper space 17 of the crank chamber 13 by the pressure difference due to the compression of the pistons 16.

In the next step, the cylinder #3 or #4 is ignited and the pistons 16 assembled in these cylinders are moved rearward, whereby the gas in the space 17 of the crank chamber 13 is forcibly moved towards the front portion of the engine 11.

Thereafter, when cylinder #2 or #1 is ignited, the piston 16 assembled in the cylinder is moved rearward to compress the gas flowing in the space 17 of the crank chamber 13. The compressed gas flows downwardly towards the oil pan 19 through a space between one of the bearing members 14 disposed between the cylinders #1 and #2 and another one of the bearing members 14 disposed on the front side of the engine 11. During the flow of the compressed gas, the flow speed of the gas is increased at a time of passing the space narrowed by the expanded portion formed to the extended end portion 14*a* of certain one bearing member 14. The gas having the increased speed is then blasted on the gas baffle 20 closing the lower portion of the crank chamber 13.

The blasted gas then flows along the guide surface 20*c* formed to the front portion of the gas baffle 20 and is discharged through the opening 20*d* formed at the near end portion of the gas baffle 20. A part of the discharged gas from the opening 20*d* is forcibly moved towards the upper space 17 in the crank chamber 13 from the rear side of the engine 11 and another part of the discharged gas is blasted against the oil surface of the lubrication oil stored in the oil pan 19.

Accordingly, as described above, the compressed gas can smoothly circulate in the crank chamber 13, thus remarkably reducing so-called pumping loss during engine high speed operation.

In addition, the gas blasted from the crank chamber 13 flows rearwardly along the guide surface 20*c* of the gas baffle 20, so that the oil level of the lubrication oil is not forced upwardly, thus preventing the oil surface from being agitated and the temperature of the lubrication oil from increasing.

Furthermore, the blasting of the gas discharged from the opening 20*d* on the oil surface of the lubrication oil in the oil pan effectively corrects the relative inclination of the oil surface if the engine 11 is mounted on a vehicle so as to hung up the front side of the engine 1.

While the presently preferred embodiments of the present invention have been shown and described, it is to be understood that this disclosure is for the purpose of illustration and that various changes and modifications may be made without departing from the scope of the invention as set forth in the appended claims. For, example, the present invention can be easily applied to a horizontally-opposed engine having four cylinders or more then eight cylinders.

What is claimed is:

1. A horizontally-opposed multiple-cylinder engine provided with a cylinder block having two opposed banks respectively including cylinders in which pistons move to bottom dead center comprising:

a crank chamber defined between the two banks in said cylinder block and provided with an upper space;

an oil pan disposed below said crank chamber, in which a lubrication oil is stored; and a gas baffle disposed between a lower portion of said crank chamber and the lubrication oil stored in said oil pan at a position where a gas flows downwardly from the upper space, said gas baffle being provided with an opening formed at an end portion of the gas baffle opposed to one cylinder which operates to force gas in the crank chamber to the upper space therein.

2. The horizontally-opposed multiple-cylinder engine according to claim 1, wherein said gas baffle comprises a gas baffle plate formed by drawing a steel plate.

3. The horizontally-opposed multiple-cylinder engine according to claim 2, wherein said gas baffle plate has one side portion in which an oil return hole is formed.

4. The horizontally-opposed multiple-cylinder engine according to claim 2, wherein said gas baffle plate is provided with a gas guiding surface at a portion of the gas baffle plate opposed to the opening.

* * * * *